US010381769B2

(12) United States Patent
Guitard et al.

(10) Patent No.: US 10,381,769 B2
(45) Date of Patent: Aug. 13, 2019

(54) FEMALE CONNECTOR PLUG INCLUDING A LOCK

(71) Applicants: LEGRAND SNC, Limoges (FR); LEGRAND FRANCE, Limoges (FR)

(72) Inventors: Julien Guitard, Saint Antoine l'Abbaye (FR); Didier Revol, Chatte (FR)

(73) Assignees: LEGRAND SNC, LIMOGES (FR); LEGRAND FRANCE, LIMOGES (FR)

( * ) Notice: Subject to any disclaimer, the term of this patent is extended or adjusted under 35 U.S.C. 154(b) by 0 days.

(21) Appl. No.: 15/779,908

(22) PCT Filed: Oct. 28, 2016

(86) PCT No.: PCT/FR2016/052810

§ 371 (c)(1),
(2) Date: May 30, 2018

(87) PCT Pub. No.: WO2017/093624

PCT Pub. Date: Jun. 8, 2017

(65) Prior Publication Data

US 2018/0375246 A1 Dec. 27, 2018

(30) Foreign Application Priority Data

Nov. 30, 2015 (FR) ..... 15 61555

(51) Int. Cl.
*H01R 13/506* (2006.01)
*H01R 13/46* (2006.01)
(Continued)

(52) U.S. Cl.
CPC ..... *H01R 13/506* (2013.01); *H01R 4/2416* (2013.01); *H01R 13/465* (2013.01);
(Continued)

(58) Field of Classification Search
CPC .. H01R 13/639; H01R 13/465; H01R 13/501; H01R 13/502; H01R 24/64
(Continued)

(56) References Cited

U.S. PATENT DOCUMENTS 5,762,518 A * 6/1998 Tanigawa ..... H01R 4/2412 439/409
5,947,761 A * 9/1999 Pepe ..... H01R 4/2433 439/409
(Continued)

FOREIGN PATENT DOCUMENTS

CN 106063049 A 10/2016
DE 102008064535 A1 6/2010
(Continued)

OTHER PUBLICATIONS

International Search Report and Written Opinion for PCT Patent App. No. PCT/FR2016/052810 (dated Jan. 30, 2017) with English translation of the ISR.

*Primary Examiner* — Tulsidas C Patel
*Assistant Examiner* — Peter G Leigh
(74) *Attorney, Agent, or Firm* — Kenealy Vaidya LLP

(57) ABSTRACT

Some embodiments are directed to a connector-type female plug including a body; a module including a plurality of slots, each of the slots configured to receive an end of a strand of a cable and arranged so as to be plugged into by a rear face of the body; a lever pivotably mounted on the body in such a way as to be able to move between an open position and a closed position attained after lowering the lever in such a way as to grasp a rear face of the module and to push same into a completely plugged-in position; and a lock that can move along a sliding mechanism between a locked
(Continued)

position, in which the lock is arranged in such a way as to hold the lever in the closed position, and an unlocked position.

20 Claims, 2 Drawing Sheets

(51) Int. Cl.
*H01R 13/50* (2006.01)
*H01R 13/639* (2006.01)
*H01R 24/64* (2011.01)
*H01R 4/2416* (2018.01)

(52) U.S. Cl.
CPC ..... *H01R 13/501* (2013.01); *H01R 13/639* (2013.01); *H01R 24/64* (2013.01)

(58) Field of Classification Search
USPC ..... 439/391
See application file for complete search history.

(56) References Cited

U.S. PATENT DOCUMENTS 5,957,720 A * 9/1999 Boudin ..... H01R 24/64 439/409
6,123,572 A 9/2000 Ishii et al.
7,413,464 B1 * 8/2008 Chen ..... H01R 4/2433 439/404
7,713,081 B2 * 5/2010 Chen ..... H01R 9/037 439/409
7,918,684 B2 * 4/2011 Lu ..... H01R 4/2433 439/395
8,007,307 B2 * 8/2011 Wang ..... H01R 13/506 439/367
8,215,980 B1 * 7/2012 Lin ..... H01R 4/2433 439/404
8,333,607 B1 * 12/2012 Moldoch ..... H01R 4/2433 439/367
8,834,196 B2 * 9/2014 Duran ..... H01R 9/032 439/459
9,130,283 B1 * 9/2015 Lin ..... H01R 13/5841
2005/0079750 A1 4/2005 Foster
2014/0302714 A1 * 10/2014 Luettermann ..... H01R 13/514 439/607.55

FOREIGN PATENT DOCUMENTS

DE 202012100261 U1 12/2012
EP 2806500 A1 11/2014
WO WO2015/114662 A1 8/2015

* cited by examiner

FEMALE CONNECTOR PLUG INCLUDING A LOCK

CROSS REFERENCE TO RELATED APPLICATIONS

This application is a national phase filing under 35 C.F.R. § 371 of and claims priority to PCT Patent Application No. PCT/FR2016/052810, filed on Oct. 28, 2016, which claims the priority benefit under 35 U.S.C. § 119 of French Patent Application No. 1561555, filed on Nov. 30, 2015, the contents of each of which are hereby incorporated in their entireties by reference.

BACKGROUND

Some embodiments relate to connectors of IT and telecommunications networks, and more particularly to a female connector plug, for example an RJ45 connector, including a lock able to lock or unlock the connector. Such a connector is typically intended to be used in a patch panel, in particular in a high-density patch panel.

Related art connectors include a female plug, fastened to a patch panel or to a wall, and of a male plug, linked to a connection cable such as a patch cable, able to be plugged into the female plug. The female plug includes a plug body intended to be connected by a front face to the male plug. The plug body includes insulation displacement contacts arranged in such a way as to each receive strands contained in a feed cable. The female plug also includes a connection module including several slots each intended to receive an end of a strand of a cable. The connection module is either fixed, or articulated in relation to the plug body or separated from the plug body. When the connection module is articulated or separated, it is arranged so as to be plugged into by a rear face of the plug body or by a lateral face, in such a way as to push each strand against the corresponding insulation displacement contact.

In the case of a related art articulated or separate connection module, the female plug is provided with at least one pressing lever pivotably mounted on the plug body. The lever has an open position, wherein the lever does not constrain the connection module, and a closed position, wherein the lever constrains the connection module in a completely plugged-in position.

In accordance with the related art, in order to maintain the pressing lever in the closed position, the female plug is provided with a locking system. Certain connectors do not allow for a manual locking and may require the use of a tool for the implementing of the locking system. Other connectors have a manual locking system manual, but the manipulation that may be required to lock the connector is laborious due to a reduced gripping zone and sometimes painful due to poor ergonomics of the locking system.

SUMMARY

For certain connectors, the unlocking system does not exist, which imposes a destruction of the connector in case of modification of the cabling of the connector, in particular during maintenance operations. The connectors including an unlocking system are designed in such a way as to prevent accidental unlocking, which frequently results in poor unlocking ergonomics.

Some embodiments are directed to addressing or overcoming the aforementioned disadvantages, and are partially directed to a connector including a lock that makes it possible to lock and unlock the connector manually in an ergonomic manner, while still preventing or impeding accidental unlockings.

Some embodiments are directed to a connector-type female plug including a body able to be connected by a front face to a complementary male plug and including a plurality of insulation displacement contacts; a separate connection module including a plurality of slots each intended to receive an end of a strand of a cable and arranged so as to be plugged into by a rear face of the body in such a way as to push each strand against the corresponding insulation displacement contact; and a lever pivotably mounted on the body in such a way as to be able to move between an open position and a closed position attained after lowering the lever in such a way as to grasp a rear face of the module and to push the module into a completely plugged-in position. The female plug includes a lock that is movable according to a sliding movement between a locked position, in which the lock is arranged in such a way as to hold the lever in the closed position, and an unlocked position.

The lock mounted in sliding makes it possible to provide a locking that is ergonomic, intuitive and safe. The unlocking manipulation is the same as the locking manipulation in the opposite direction. The unlocking is therefore also ergonomic and intuitive.

According to a particular embodiment, the sliding mechanism includes at least one slide, such as a slit or a groove, and at least one sliding element, such as a lug or a rod.

According to a particular embodiment, the slide is integral with the lock and the sliding element is integral with the lever. For example, the slide is in a slit in the lock wherein a lug of the lever slides.

According to a particular embodiment, the lock has a general U shape which cooperates with the lever. More precisely, the U-shaped lock cooperates with two lateral faces of the lever and an upper face. The lock then includes two slits, one on each branch of the U and the lever includes two lugs, one on each lateral face. The U shape provides the lock with a wide gripping zone, which contributes to its ergonomics.

According to a particular embodiment, the slide is integral with the lever and the sliding element is integral with the lock. For example, the slide is a slit in the lever wherein a lug of the lock slides.

According to a particular embodiment, the body includes a housing intended for the lock. The lock is arranged in such a way as to be engaged with the housing.

According to a particular embodiment, the module includes a housing intended for the lock. The lock is arranged in such a way as to be engaged with the housing in the locked position.

According to a particular embodiment, the lock is slidably mounted on the body. For example, the body includes a slide wherein a rod slides in such a way that in the locked position of the lock, one end of the rod is engaged with the lever in the closed position.

According to a particular embodiment, the lock is slidably mounted on the module. For example, the module includes a slide wherein a rod slides in such a way that in the locked position of the lock, one end of the rod is engaged with the lever in the closed position.

According to a particular embodiment, the sliding mechanism includes a hard spot between the locked position and the unlocked position.

The term "hard spot" means an element in an articulation, such as a zone of friction or a protrusion, increasing the force that may be required to actuate the articulation between two positions.

The hard spot makes it possible to impede or prevent the accidental passage of a lock from one position to another in the absence of manipulation. It makes it possible in particular to impede or prevent an accidental unlocking.

According to a particular embodiment, the lock includes a deformation zone including the hard spot. The deformation zone allows for a local elastic deformation around the hard spot in such a way as to facilitate the passage of the hard spot. For example, a deformation zone of one or two millimetres thick is created between the slide and a slit parallel to the slide. During the passage of the hard spot, the deformation zone is deformed in such a way that a portion of the deformation zone is displaced in the parallel slit.

According to a particular embodiment, the female plug includes a return mechanism of the lock arranged in such a way as to return the lock to the locked position in the absence of manipulation of the lock.

According to a particular embodiment, the lock is in the locked position when the lever is in the closed position. As such, the manipulation, which includes closing the lever, makes it possible, in the same movement, to lock the lock. For example, in a movement of lowering the lever, an inclined plane pushes back the lock to the unlocked position, then the inclined plane is interrupted and a return mechanism returns the lock to the locked position.

According to a particular embodiment, the female plug includes a display which indicates the locked position or the unlocked position in order to render the manipulation of the lock intuitive.

According to a particular embodiment, the lock includes a non-slip gripping zone in order to impede or prevent the user from slipping during the locking or the unlocking of the lock.

BRIEF DESCRIPTION OF THE FIGURES

Other characteristics and innovative advantages shall appear in the description hereinafter, provided for the purposes of information and in no way limiting, in reference to the annexed drawings, wherein.

DETAILED DESCRIPTION OF EXEMPLARY EMBODIMENTS

Figure 1:
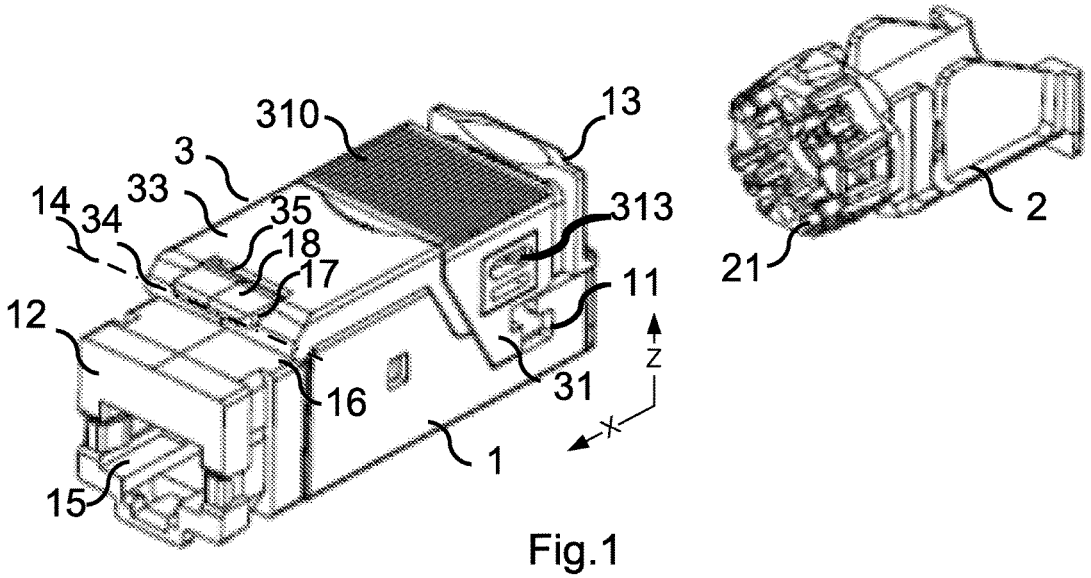
FIG. 1 diagrammatically shows a perspective view of a female connector plug according to an embodiment.

FIGS. 1 to 6 show a female plug according to an embodiment, with respect to a longitudinal axis X and a vertical axis Z. The female plug shown is of the RJ45 type. Some embodiments relate more generally to a connector for an IT and telecommunications network, such as an RJ11, RJ12, RJ25, RJ45, ARJ45 or RJ48 connector.

The female plug includes a body 1, a module 2 and a lever 3. The body 1 extends along the longitudinal axis X and includes a front face 12, with the front being defined by the direction of the vector X. The front face 12 includes an orifice 15 intended to receive a complementary male plug of the female plug. The body 1 includes insulation displacement contacts (not shown) each intended to receive a strand of a feed cable 4. The body 1 also includes a rear face 13, with the rear being defined by the direction opposite that of the vector X, intended to receive the module 2. The body also includes an upper face 16, defined as the highest face along the vertical vector Z, intended to support the lever 3.

The module 2 is a separate element of the plug body including several slots 21 each intended to receive an end of a strand of a cable 4. The module 2 is arranged so as to be plugged into by an orifice of the rear face 13 of the body 1 in order to push each strand against the corresponding insulation displacement contact.

The lever 3 is pivotably mounted around an axis 14 of the upper face 16. The axis 14 is constituted by the rounded bottom of a housing 17 formed between the upper face 16 and a tab 18 extending parallel to the upper face 16, in the direction of the front face 12. The axis 14 cooperates with a pivot 34 of cylindrical shape present at a free end of the lever 3 and constituted by an edge of a window 35.

Figure 2:
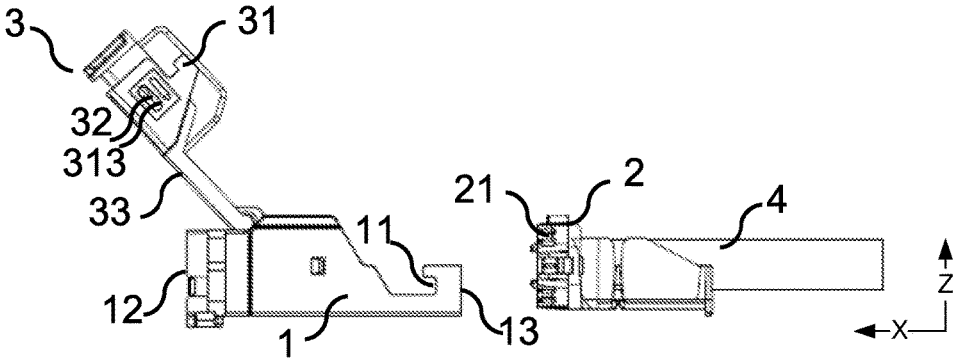
FIG. 2 shows a diagrammatical side view of a female connector plug according to the embodiment of FIG. 1 in an open position of the lever.

In reference to FIG. 2, the lever 3 has an open position, wherein the lever 3 is dissociated from the module 2. In reference to FIG. 3, the lever 3 has a closed position wherein the lever 3 is folded back in such a way as to grasp a rear face of the module 2 shaped in consequence and to push the module 2 into a completely plugged-in position. Advantageously, the lever 3 includes an arm 33 elongated according to a direction perpendicular to the axis 14 in order to obtain a leverage effect that makes it possible to reduce the force that may be required to push the module 2 to a completely plugged-in position. In the open position of the lever, the elongated portion forms an opening angle that decreases as the lever closes until it is substantially zero in the closed position.

The lever 3 includes a lock 31 including a locked position, wherein the lever 3 is blocked in the closed position and an unlocked position, wherein the lever 3 is free to pass from the closed position to the open position. The lock 31 is arranged in such a way as to pass from one position to the other via a manual manipulation. In the embodiment shown in FIGS. 1 to 4, the lock slides along an axis parallel to the longitudinal segment connecting the front face 12 of the body 1 to the rear face 13 of the body 1 in the closed position of the lever 3. The lock 31 cooperates with the lever 3 and the body 1. Advantageously, the lock 31 has a U shape in such a way as to catch in between the distal end of the lever 3. The ergonomics of the manipulation of the lock 31 is favoured by an elongated shape of the connector, of a length of about a few centimeters. The ergonomics are also favoured by a short travel of the lock 31, of about a few millimeters, and by a non-slip gripping zone 310 on an upper portion of the lock 31 connecting two lateral portions.

Figure 4:
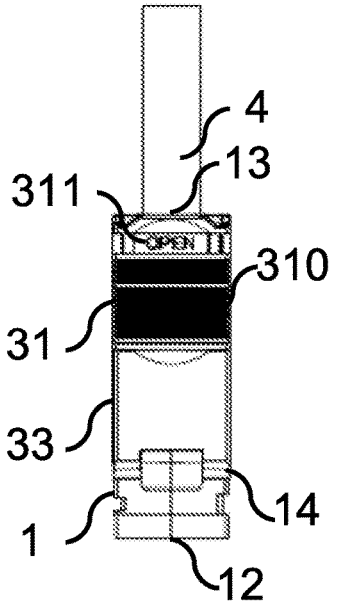
FIG. 4 diagrammatically shows a top view of a female connector plug according to the embodiment of FIG. 1 in a closed position of the lever and an unlocked position of the lock.

In reference to FIG. 4, a display on the pressing lever makes it possible to identify the locked position by the mention "LOCKED" 312 and the unlocked position by the mention "OPEN" 311. In the locked position, the lock is positioned in such a way as to hide the mention "OPEN" 311 and to reveal the mention "LOCKED" 312 and inversely for the unlocked position. Alternatively, these mentions can be replaced with a colour code.

According to an advantageous or preferred embodiment, the body 1 includes a housing 11 in the shape of a hook intended to be engaged with one end of the lock 31 shaped in consequence. The nesting obtained as such maintains the pressing lever in the closed position. Alternatively, the housing 11 is integral with the module 2.

Figure 3:
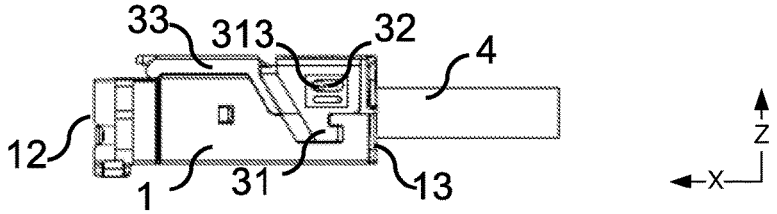
FIG. 3 shows a diagrammatical side view of a female connector plug according to the embodiment of FIG. 1 in a closed position of the lever and a locked position of the lock.
Figure 5:
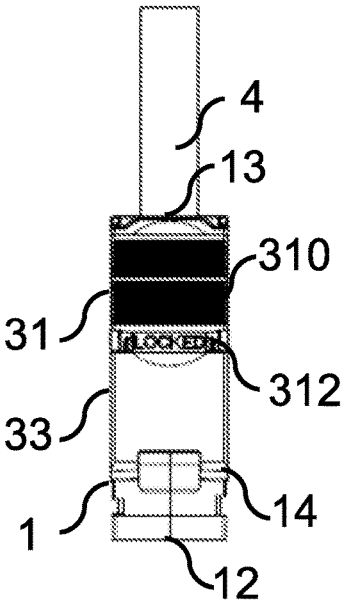
FIG. 5 diagrammatically shows a top view of a female connector plug according to the embodiment of FIG. 1 in a closed position of the lever and a locked position of the lock.
Figure 6:
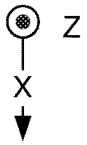
FIG. 6 diagrammatically shows a view of the lock of a female connector plug according to the embodiment of FIG. 1.
Figure 6:
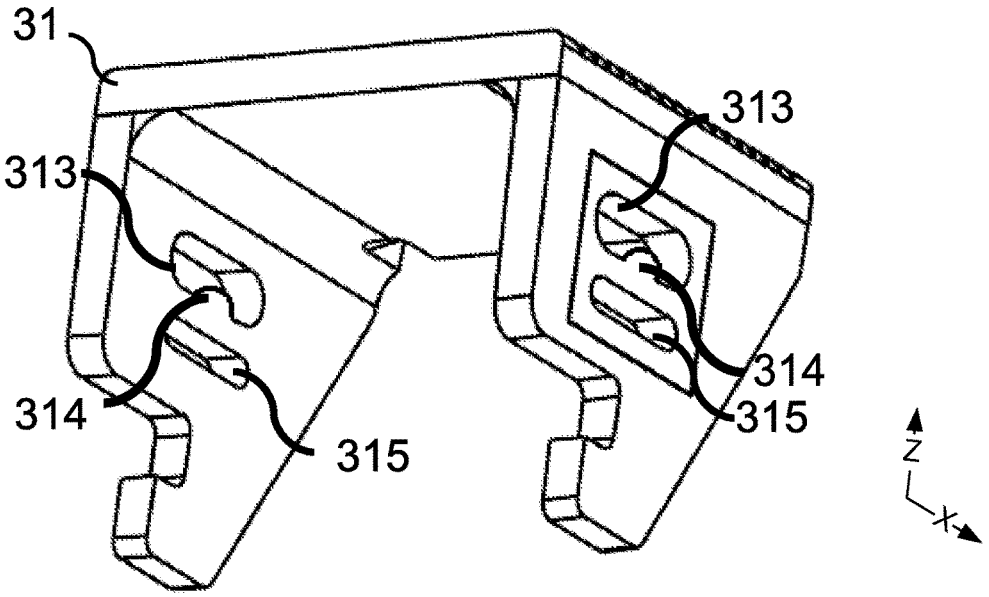

In reference to FIGS. 2, 3 and 5, the lock 31 slides according to a sliding mechanism including a slide 313, for example a groove or a slit, and a sliding element 32 able to slide in the slide 313. The slide 313 is integral with the lock 31 and the sliding element 32 is integral with the lever 3. Alternatively, the slide 313 is integral with the lever 3 and the sliding element 32 is integral with the lock 31.

Advantageously, the slide 313 includes a hard spot 314 in its middle in such a way that a force may be required to allow the sliding element 32 to pass the hard spot 314. This arrangement makes it possible to maintain the lock in a locked or unlocked position in the absence of manipulation. According to an advantageous or preferred embodiment, the lock 31 includes a recess 315 in the vicinity of the hard spot 314, for example a groove parallel to the slide 313, arranged in such a way as to allow for an elastic deformation of the portion of the lock between the slide 313 and the recess 315 during the passage of the hard spot 314 by the sliding element 32 between the locked position and the unlocked position.

According to other embodiments, the lock is slidably mounted in relation to the body 1 or to the module 2 in such a way as to be engaged with the lever 3 in the locked position. In the embodiment wherein the lock is slidably mounted in relation to the body 1, the slide 313 is integral with the body 1 and the sliding element 32 is a rod. The locked position of the lock is obtained when an end of the rod is housed in a housing of the lever 3 in the closed position. In the embodiment wherein the lock is slidably mounted in relation to module 2, the slide 313 is integral with the module 2 and the sliding element is a rod. Similar to what is described hereinabove, the locked position is obtained when an end of the rod is housed in a housing of the lever 3 in the closed position.

According to an embodiment not shown, the lock 31 includes a return mechanism, of the spring or elastic return type, arranged in such a way as to return the lock 31 to the locked position in the absence of manipulation of the lock 31.

According to an enhanced or improved embodiment, the lock 31 including a return mechanism such as described hereinabove, the lock 31 is arranged in such a way as to be automatically in the locked position when the lever is in the closed position. For example, the body 1 includes an inclined plane in the extension of the housing 11, arranged in such a way that an end of the lock comes into contact with the inclined plane during a closing movement of the lever 3, in such a way that the progression of the closing movement causes a pressure on the end sliding the lock from the locked position to the unlocked position. When the end leaves the inclined plane, the return mechanism pushes the lock to the locked position, the end is then placed in the housing 11.

Some embodiments are described hereinabove by way of example. It is understood that those of ordinary skill in the art are able to produce various alternative embodiments, by combining for example the various characteristics hereinabove taken individually or in combination, without however leaving the scope of some embodiments.

The invention claimed is:

1. A female plug, comprising:

a body configured to be connected by a front face to a complementary male plug and including a plurality of insulation displacement contacts;

a separate connection module including a plurality of slots, each of the slots being configured to receive an end of a strand of a cable and arranged so as to be plugged into by a rear face of the body in such a way as to push each strand against the corresponding insulation displacement contact;

a lever pivotably mounted on the body in such a way as to be able to move between an open position and a closed position attained after lowering the lever in such a way as to grasp a rear face of the module and to push the module into a completely plugged-in position; and a lock configured for movement by sliding along a sliding guide between a locked position, wherein the lock holds the lever in the closed position, and an unlocked position.

2. The female plug as claimed in claim 1, wherein the sliding mechanism includes at least one slide and at least one sliding element.

3. The female plug as claimed in claim 2, wherein the slide is integral with the lock and the sliding element is integral with the lever.

4. The female plug as claimed in claim 3, wherein the lock has a U shape that cooperates with the lever.

5. The female plug according to claim 4, wherein the body includes a housing intended for the lock.

6. The female plug as claimed in claim 4, wherein the sliding mechanism includes a hard spot between the locked position and the unlocked position.

7. The female plug as claimed in claim 4, wherein the lock is in the locked position when the lever is in the closed position.

8. The female plug according to claim 3, wherein the body includes a housing intended for the lock.

9. The female plug as claimed in claim 8, wherein the sliding mechanism includes a hard spot between the locked position and the unlocked position.

10. The female plug as claimed in claim 8, wherein the lock is in the locked position when the lever is in the closed position.

11. The female plug as claimed in claim 3, wherein the sliding mechanism includes a hard spot between the locked position and the unlocked position.

12. The female plug as claimed in claim 3, wherein the lock is in the locked position when the lever is in the closed position.

13. The female plug as claimed in claim 2, wherein the sliding mechanism includes a hard spot between the locked position and the unlocked position.

14. The female plug as claimed in claim 2, wherein the lock is in the locked position when the lever is in the closed position.

15. The female plug as claimed in claim 1, wherein the sliding mechanism includes a hard spot between the locked position and the unlocked position.

16. The female plug as claimed in claim 15, wherein the lock includes a deformation zone comprising the hard spot (314).

17. The female plug as claimed in claim 15, wherein the lock is in the locked position when the lever is in the closed position.

18. The female plug as claimed in claim 1, wherein the lock is in the locked position when the lever is in the closed position.

19. The female plug as claimed in claim 1, wherein the lock includes a non-slip gripping zone.

20. A female plug, comprising:

a body configured to be connected by a front face to a complementary male plug and including a plurality of insulation displacement contacts;

a separate connection module including a plurality of slots, each of the slots being configured to receive an end of a strand of a cable and arranged so as to be plugged into by a rear face of the body in such a way as to push each strand against the corresponding insulation displacement contact;

a lever pivotably mounted on the body in such a way as to be able to move between an open position and a closed position attained after lowering the lever in such a way as to grasp a rear face of the module and to push the module into a completely plugged-in position;

a lock configured for movement by sliding along a sliding guide between a locked position, wherein the lock is further configured to hold the lever in the closed position, and an unlocked position; and a display which indicates the locked position or the unlocked position.

* * * * *